US007921477B2

(12) United States Patent
Casale

(10) Patent No.: US 7,921,477 B2
(45) Date of Patent: Apr. 12, 2011

(54) LAVATORY SEAT VENTILATION SYSTEM

(76) Inventor: Enzo Casale, Norwich (GB)

( * ) Notice: Subject to any disclaimer, the term of this patent is extended or adjusted under 35 U.S.C. 154(b) by 873 days.

(21) Appl. No.: 10/544,077

(22) PCT Filed: Feb. 5, 2004

(86) PCT No.: PCT/GB2004/000450

§ 371 (c)(1),
(2), (4) Date: Jun. 9, 2006

(87) PCT Pub. No.: WO2004/070126

PCT Pub. Date: Aug. 19, 2004

(65) Prior Publication Data

US 2006/0260028 A1 Nov. 23, 2006

(30) Foreign Application Priority Data

Feb. 7, 2003 (GB) ..... 0302838.8

(51) Int. Cl.
*E03D 9/04* (2006.01)

(52) U.S. Cl. ..... 4/213; 4/216

(58) Field of Classification Search ..... 4/213, 217
See application file for complete search history.

(56) References Cited

U.S. PATENT DOCUMENTS

| | | | | |
|---|---|---|---|---|
| 3,333,285 | A * | 8/1967 | Null | 4/217 |
| 3,366,979 | A * | 2/1968 | Johnston | 4/213 |
| 3,659,296 | A * | 5/1972 | Stamper | 4/217 |
| 5,079,783 | A * | 1/1992 | Haletsky et al. | 4/217 |
| 6,540,804 | B1 * | 4/2003 | Wennerstrom | 55/472 |

* cited by examiner

*Primary Examiner* — Khoa D Huynh
*Assistant Examiner* — Karen Younkins
(74) *Attorney, Agent, or Firm* — Barnes & Thornburg LLP

(57) ABSTRACT

A seat for a lavatory pan, which includes within its thickness at least one cavity for a deodorizing filter and at least one cavity in the seat or the filter for an electrically powered fan. Air inlet openings are provided in the seat through which air can pass into the filter cavity. The openings are situated around the inside edge of the opening in the seat or in a region of the underside of the seat which does not make sealing contact with the rim of the pan when the seat is lowered and in use and is subject to the weight of a person seated thereon. An air outlet by which odor-free air can exit after being drawn through the filter by operation of the fan, is situated in the rear edge of the seat.

16 Claims, 5 Drawing Sheets

LAVATORY SEAT VENTILATION SYSTEM

FIELD OF INVENTION

Figure 1:
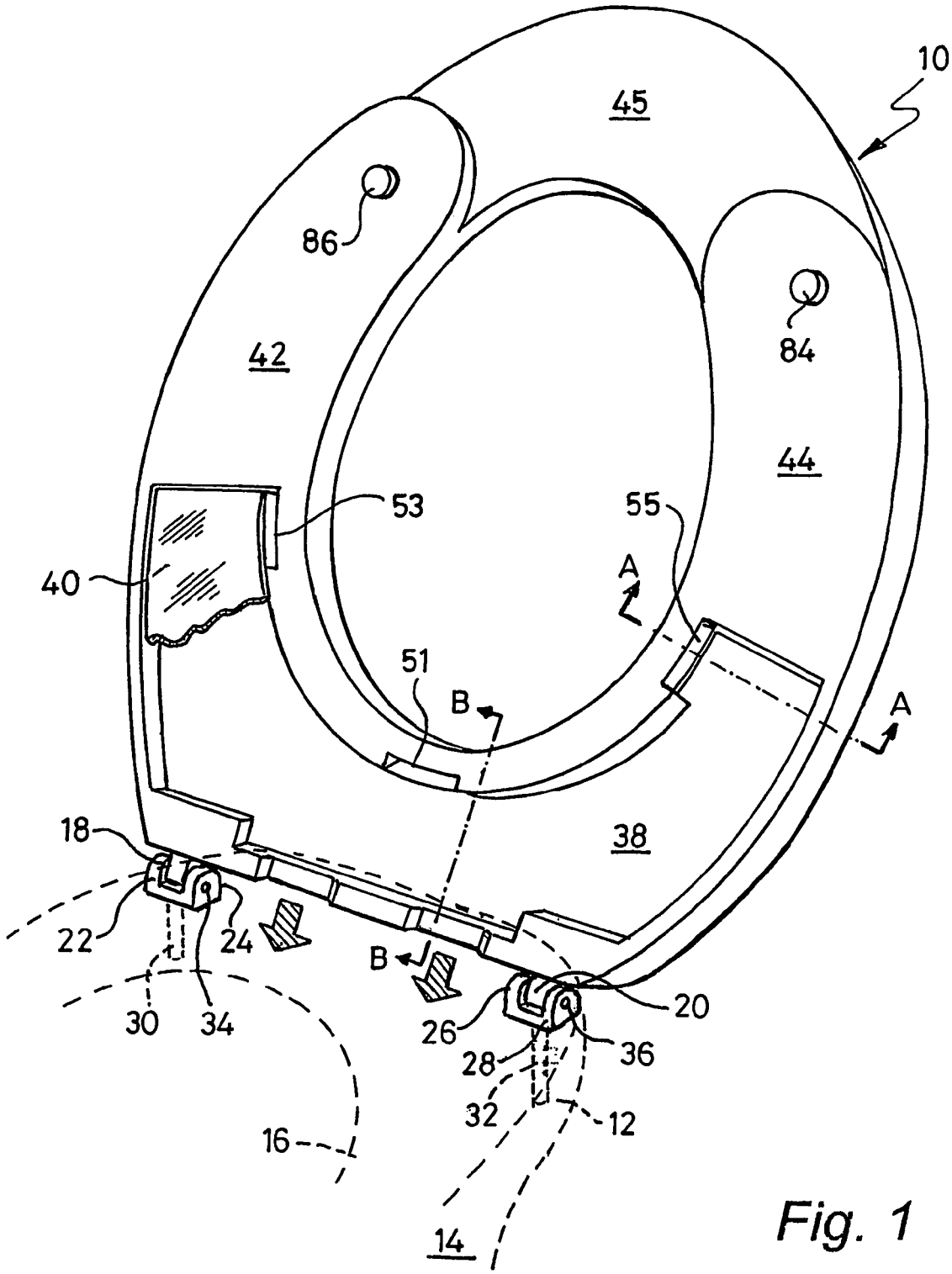

This invention concerns ventilation systems for lavatory seats, and in particular an improved lavatory seat.

BACKGROUND TO THE INVENTION

It has been proposed in GB 2,266,901 to provide a ventilation system in association with a lavatory seat of otherwise conventional design such that air can be drawn by a fan (34), located remote from the pan (10), via an aperture (30) in a part of the hinge (16) by which the seat is mounted to the pan, and a pipe (32) leading from the rear of the hinge part to the fan, which latter may be mounted in an exterior wall to exit air drawn from the upper region of the pan, externally of the room containing the pan (10).

It is an object of the present invention to provide an improved ventilation system for such applications and in particular an improved lavatory seat so that the ventilation system is more hidden from view than in the previous proposals.

SUMMARY OF THE INVENTION

According to one aspect of the present invention there is provided a method of ventilating a lavatory whilst in use in which the lavatory pan has a seat hinged thereto, wherein when the seat is in its lowered position resting on the pan, air is drawn by the operation of motorised fan means through at least two air inlets in the lavatory seat, to be exhausted via at least one outlet in a rearwardly facing outer edge of the seat, wherein the air path through the seat comprises deodorising filter means and the fan means is located within the seat, so that substantially odour-free air is exhausted from the outlet opening.

Each inlet may be located in an edge of the seat opening or in the face of the seat which faces downwards towards the pan when in use, or in a corner between the seat opening edge and the underside face of the seat so as to partly occupy the edge and partly what is the underside of the seat when the latter is lowered into contact with the pan.

The invention also lies in a lavatory seat for use in combination with a lavatory pan in the foregoing method which comprises air inlet means through which air can be drawn, air outlet means in an outer edge of the seat which when the seat is resting on the lavatory pan, faces rearwardly of the pan, at least one deodorising filter located within the seat, and motorised fan means also located within the seat which when operating will draw air via the inlet through the filter to exhaust via the outlet means at the rear of the seat.

Each inlet preferably includes a water trap or water deflector or baffle so that if water splashes onto the underside of the seat when the seat is lowered or raised, the water cannot penetrate into the filter.

The deodorising filter preferably contains activated carbon or charcoal.

The fan means may be incorporated between the inlet and the filter, within the filter, or between the filter and the outlet.

The invention also lies in a seat as aforesaid in combination with sensor means which is arranged to instigate automatic operation of the fan means when the lavatory is in use.

In a seat or combination of seat and lavatory pan, and sensor means in combination therewith the sensor means may be a PIR which detects body heat from a person if seated on the lavatory, or a photocell and light source incorporating a beam of light between the cell and the source which is broken by the body of a person when seated on the lavatory, or a pressure or force sensor which detects when the seat is subjected to a downward loading as when bearing the weight of a person seated thereon, so that the fan means is caused to operate automatically when the lavatory is in use.

The automatic sensor means may include switch means which is operable by the weight of a person seated on the lavatory seat, in which event the switch means may be located in the seat and the switch means is normally open when the seat is in its raised position or is lowered but unoccupied, but which is closed when a person sits on the seat.

The combination may further comprise control means including resettable timing means which in use causes the fan means to operate for a predetermined period of time after the sensor means has instigated operation thereof.

The sensor means is preferably adapted to provide two signals, a first signal when the lavatory seat is first occupied and a second signal when the lavatory seat is vacated, and operation of the fan means is instigated in response to the first signal and remains operating until a stop signal is generated a given period of time after the second signal has been generated.

The invention also lies in a lavatory seat and pan as aforesaid in combination with manually operable switch means adjacent the pan, and positioned to allow a person seated thereon to operate the switch means, so that operation of the fan is under the control of the person using the lavatory, and is instigated by the action of manually pressing the switch means.

Such a combination may also comprise control means which includes timing means adapted to cause the fan means to continue to operate for a predetermined period of time after the switch means has been depressed.

Where the switch means is of the type which has to be turned ON and OFF as by depressing the switch means first to turn it ON and a second time to turn it OFF, and control means may be provided which includes timing means to turn off the fan means and override the manual switch means if the latter has been left ON, so that the fan means will be stopped after a period of time determined by the timing means even if a person using the lavatory forgets to turn the switch OFF after use.

Preferably the fan means is driven by at least one electrically powered motor.

Wires for carrying electric current from a battery or power supply to the or each fan motor may be conveyed thereto from beneath a lip at the rear of the pan via conduit means formed in or extending through openings in the pan lip.

Where the seat is mounted on the rear pan lip by two hinges, each comprising two hingedly joined parts, one part of each of which extends from or is secured to the seat and the other part of each of which is secured to the pan by a threaded stud which passes through a hole through the pan lip, the conduit means may be formed at least in part by at least one axial bore through one or both of the studs.

Where the fan motor operates on direct current, at least one battery may be housed within a compartment within the seat for supplying current to power the or each motor.

Preferably the battery compartment is accessible to enable the or each battery to be removed.

The battery is preferably of a rechargeable type, and if so the battery may be left in the seat for recharging and an electrical charging socket may be provided in the seat into which plug means can be inserted for connecting a source of charging current thereto and conductors in the seat connect the battery to the socket to allow current to flow therefrom to recharge the battery.

Warning lamp means may be provided for indicating if a battery needs recharging and/or when a battery is in a fully charged condition.

A seat or combination as aforesaid may include two motorised fans with the motor windings connected in series or parallel depending on the voltage of the power source available to power them.

In a seat or combination as aforesaid the air inlet means is preferably provided around the inside edge of the opening in the seat, and comprises one inlet generally central of the two hinge positions and optionally at least two others, one along each side edge of the seat opening.

In a seat or combination as aforesaid preferably the seat includes at least one cavity to accommodate filter means within the thickness of the seat, and the air inlet means communicates with the or each cavity.

In a seat or combination as aforesaid two filters may be provided, situated in cavities in side and rear regions of the seat, and a single fan means may be provided in the rear of the seat to draw air through both filters, or two fan means may be provided, one for each filter.

In a seat or combination as aforesaid a cavity may be provided in the or each filter to accommodate part of the single fan means or to accommodate the fan means associated with that filter.

Where the seat includes at least one cavity for the filter means and/or fan means, the or each cavity is preferably open to the underside of the seat, and a cover plate is provided for fitting to the underside of the seat, to enclose the filter or filters and fan means in the or each cavity.

Preferably the cover plate is formed from a non-porous wipe clean material, and is removable to allow it and the or each cavity to be cleaned.

In a seat or combination as aforesaid the seat is preferably hinged to the pan and the hinge mounting for the seat is adapted to allow at least the peripheral rim of the underside of the seat (or filter cavity cover plate where fitted) to rest on a rim of the pan, so as to be substantially sealed thereto when in use, and a region of the underside of the seat is cut-away near the front thereof to provide a passage for the inflow of air, the sealing of the seat to the pan, except for the cut-away passage at the front of the seat, preventing air from escaping from the pan between the seat and the rim of the pan, and the operation of the fan means when the seat is occupied serves to cause air to be drawn into the pan through the passage formed by the cut-away underside of the front of the seat and the rim of the pan, and to leave the pan only by entering at least one inlet in the seat and thereafter through a filter therein, to a fan before being exhausted via the air outlet opening at the rear of the seat.

When the lavatory is not in use, and the seat is left down, the underside of the seat is preferably spaced from the upper surface of the rim of the pan. To this end feet may be provided on either side of the cut-away region, which feet are positioned so as to engage the pan rim when the seat is lowered and are caused to protrude below the underside of the seat by spring means so as to prevent the underside of the seat from making contact with the pan rim when subject only to its own weight, but the spring means bring such that so that when the seat is subjected to a downward loading as when a person is seated thereon, the spring means is compressed to allow the feet to retract into the seat, so that at least the peripheral rim of the underside of the latter comes to rest in contact with the pan rim, to close the gap which otherwise will exist between the pan and the seat.

The invention also lies in a seat for a lavatory pan, which includes within its thickness at least one cavity for a deodorising filter, at least one cavity in the seat or the filter for an electrically powered fan, air inlet opening means through which air can pass into the filter cavity which opening means is situated around the inside edge of the opening in the seat or in a region of the underside of the seat which does not make sealing contact with the rim of the pan when the seat is lowered and in use and is subject to the weight of a person seated thereon, and air outlet opening means by which odour-free air can exit after being drawn through the filter by operation of the fan, the outlet opening means being situated in the rear edge of the seat, and the seat including hinge means by which it is attachable to the rear of a pan.

Preferably the hinge attachment means includes passage means through which cable means can be threaded to convey operating current to the or each fan motor from a source of current such as a battery or a transformer, or an AC/DC converter connected to an electricity supply main.

Alternatively seat at least one further cavity is provided within the seat which in use houses a battery and cable means to provide for conducting current from the battery to the or each fan motor.

The fan means may comprise two motorised fans are located in cavities in the seat (or in the or each filter) to increase the flow of air from the pan, in use.

The filter may be a single C-shaped unit for extending within the seat between inlet means and the hinged region of the seat, or two similarly shaped filters fitted into two similarly shaped symmetrically arranged compartments on opposite sides of the hinged region of the seat, and the fan means may be located in the hinged region of the seat between the central region of the single filter or between the two ends of the symmetrically arranged filters, and the outlet means.

Preferably a flat closure plate is removably securable to the underside of the seat to retain the fan or fans and filter or filters in place, but is removable when it is necessary for example to replace a filter or to service or replace a fan or fan motor or replace a battery.

In a seat as aforesaid two cavities may also be provided in the underside of the seat symmetrically arranged relative to the opening in the seat and generally near the end thereof that is remote from the hinge means by which it is to be joined to a pan, and two feet are provided one in each of the two cavities, and each foot is held captive in its associated cavity but is displaceable therein against spring means between the rear of the foot and an inner end of the cavity, the spring means normally forcing the feet in a direction out of their respective cavities so as to protrude proud of the underside surface of the seat to raise the underside of seat away from the rim of the pan when the seat is lowered and subject only to its own weight, and wherein the spring rate of the spring means is selected so that the weight of a person seated on the seat is sufficient to create a force to compress the spring means and allow the feet to retract into their respective cavities to allow at least the peripheral rim of the underside of the seat to make contact with the pan rim.

Normally open switch means may be provided in, or is associated with, at least one of the foot-containing cavities, which switch means will be closed when a person sits on the seat so as to force the feet into their cavities, but will be opened when the seat is unoccupied and under the action of the spring means the feet are once again forced to protrude from their cavities.

The switch means may include spring means which maintains the normally open condition of the switch means, and in this event the switch spring means preferably serves as the spring means for the associated foot.

A spring containing switch means may be located in each foot-containing cavity, so that each switch spring means serves as the spring means for the associated foot, even if only one of the switches is used to control the flow of current to the or each fan motor.

A seat as aforesaid when in combination with a lavatory pan, in which the position of the hinge axis and the configuration of the seat are selected such that when forced into contact with the pan rim, at least the outer peripheral region of the underside of the seat or cavity closing plate, makes good, generally airtight contact, around the rim of the pan, to prevent air from passing into or out of the pan between the underside of the seat (or plate) and the pan, except through a passage formed by a cutaway region in the front underside of the seat.

Figure 2:
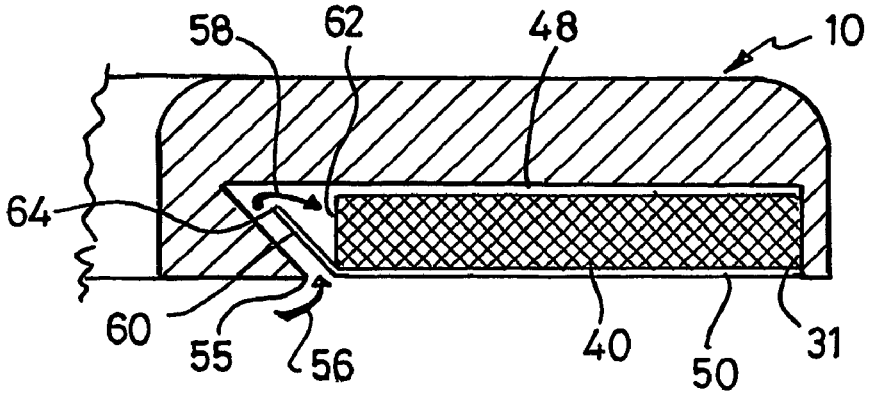
Figure 3:
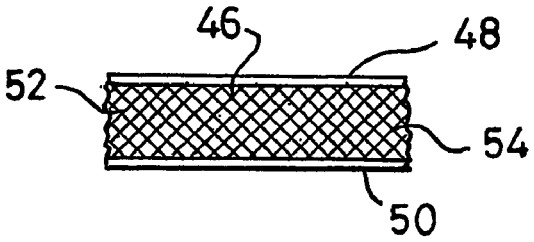
Figure 4:
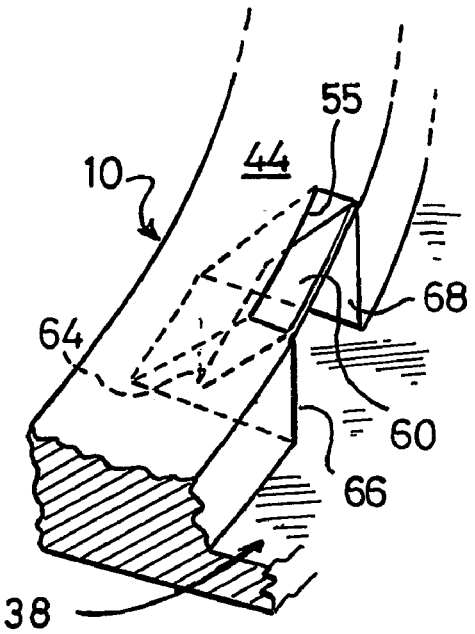
Figure 5:
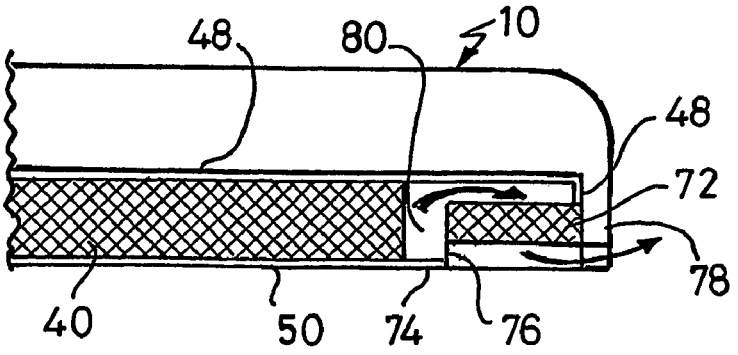
Figure 6:
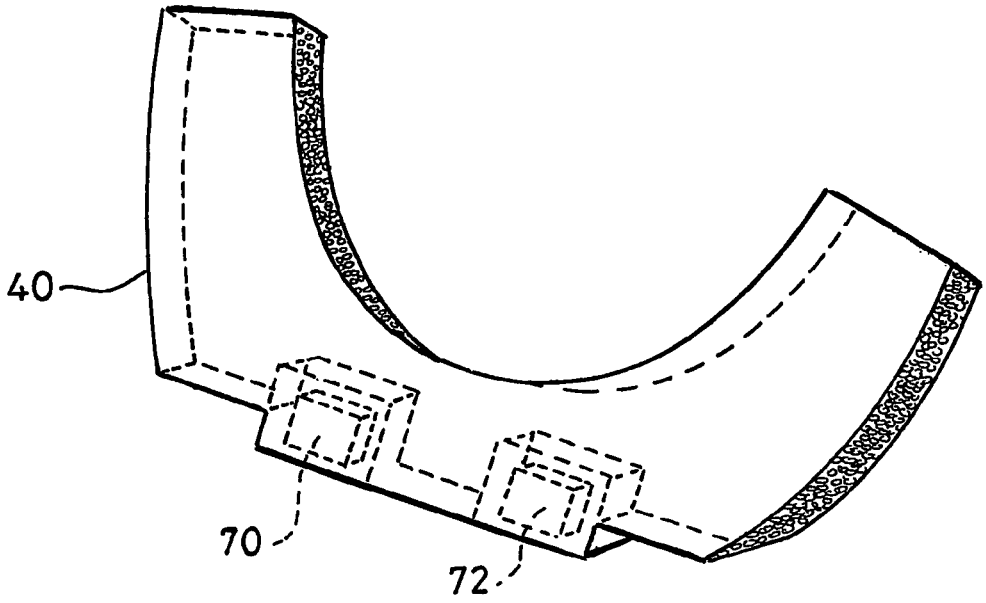
Figure 7:
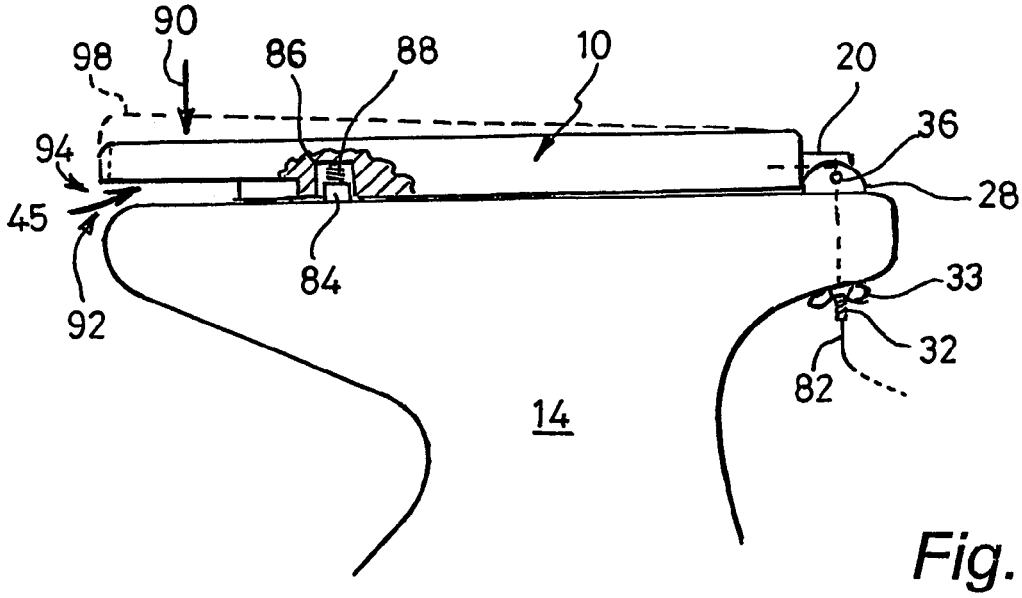
Figure 8:
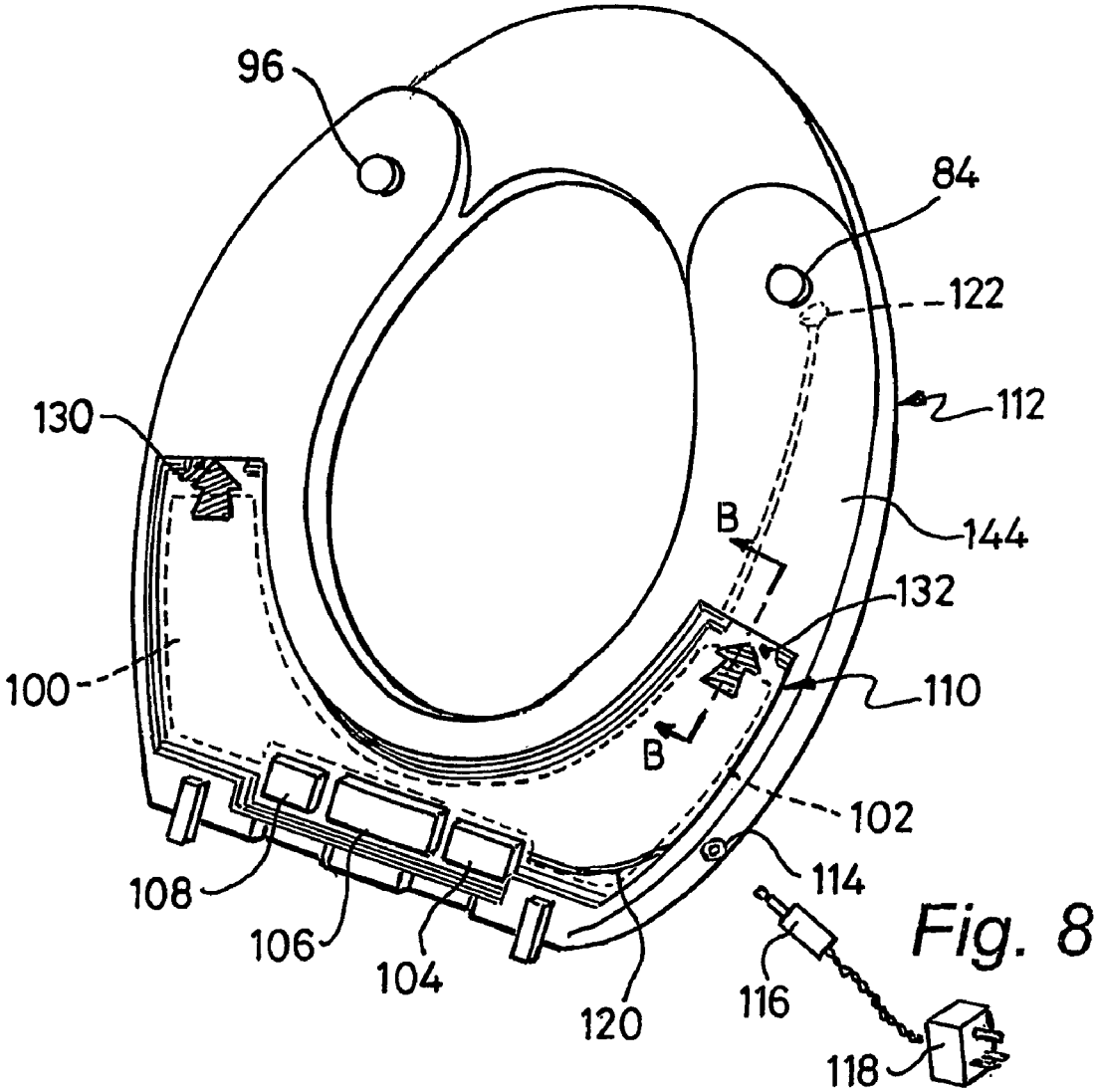
Figure 9:
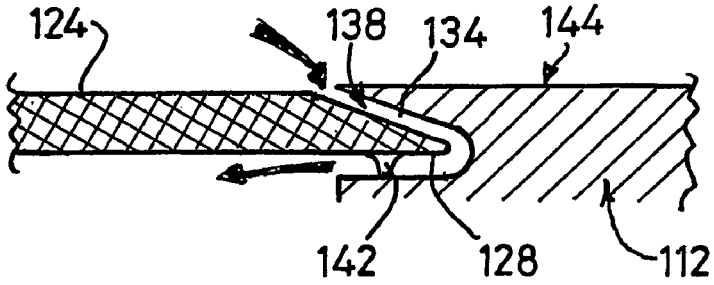
Figure 11:
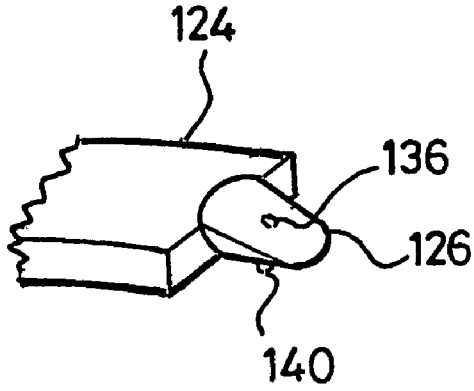
Figure 10:
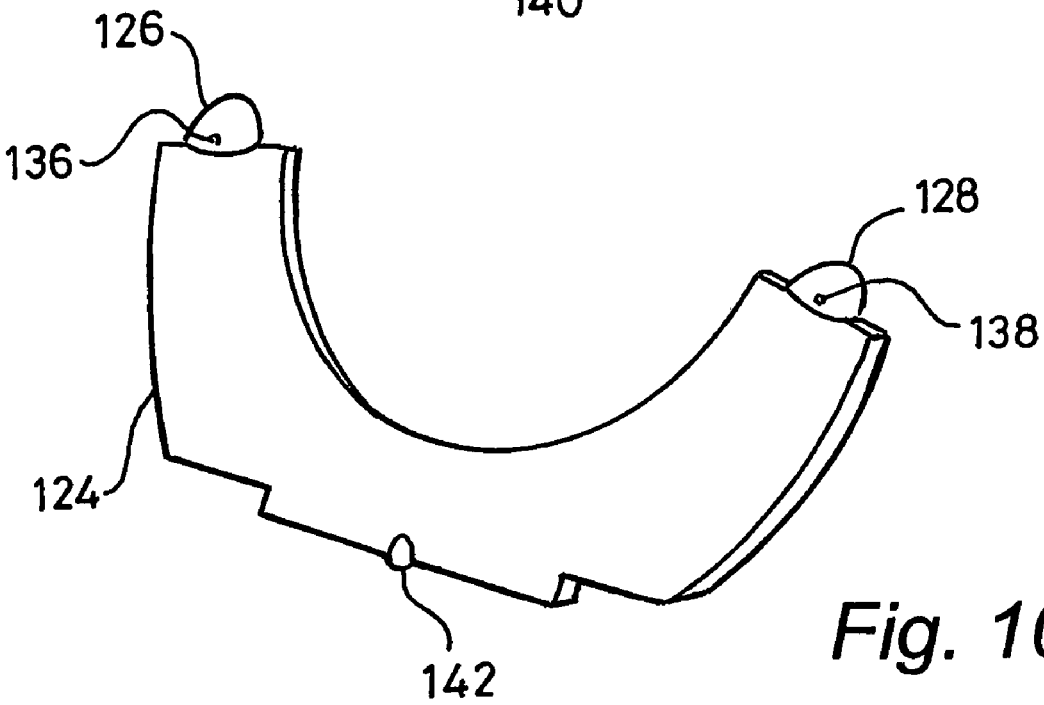
Figure 12:
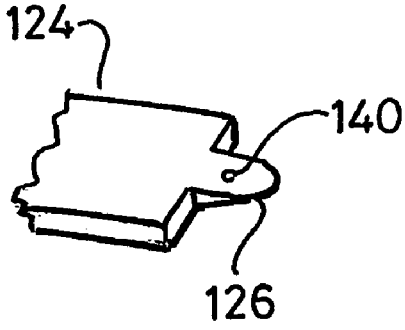

The invention will now be described by way of example with reference to the accompanying drawings, in which:

FIG. 1 is a view of the underside of a lavatory seat constructed as one embodiment of the invention, shown in its raised position relative to a pan, part of which is shown diagrammatically, FIG. 2 is a cross section, not to scale, on line AA of FIG. 1, FIG. 3 is a scrap section through the filter, FIG. 4 is a scrap perspective view of an edge region of the seat showing details of the air inlet openings, one of which is shown in FIG. 2, FIG. 5 is a cross section, not to scale, on the line BB of FIG. 1 through part of the rear hinged region of the seat, showing how fan(s) can be mounted in (or between) a compartment(s) between the filter and rear edge wall of the seat, FIG. 6 is a perspective view of a filter showing how fan(s) can be mounted integrally in the filter, so as to be replaceable as a composite filter-fan unit, FIG. 7 is a diagrammatic side view of a lavatory pan and seat constructed as an embodiment of the present invention hinged thereto, and shown in the position it will occupy during use, and in dotted outline its elevated position when the weight of a person is not acting on the seat, FIG. 8 is a perspective view of the underside of another seat embodying the invention in its raised position, showing the compartment for the filter(s) and fan(s), but without a cover plate for the compartment in place, FIG. 9 is a scrap cross section on the line BB of FIG. 8 with the cover plate in place, showing how air can enter at X or Y, FIG. 10 is a perspective view of a cover plate adapted to fit into the seat to cover the compartment but allow air to enter at X and Y (as shown in FIG. 8), and FIGS. 11 and 12 are scrap end views from above and below of one end of the cover plate of FIG. 10.

In FIG. 1 a seat embodying the invention is denoted generally as 10 as is shown hinged to a rearwardly extending lip 12 of a pan 14 having an upper rim 16 on which the seat can rest in use after being lowered from the position shown in FIG. 1. The hinges are shown as comprising stubs 18, 20 extending from the rear edge of the seat and received between parallel upstands 22, 24 and 26, 28 of two plastics mouldings having threaded studs 30, 32 extending downwardly from the base of each moulding to pass through holes (not shown) in the rear lip 12 of the pan. Wing nuts (not shown) screwed onto the studs from below, preferably with washers between the nut and the china pan, secure the mouldings in position. Pins 34, 36 allow the stubs 18, 20 and therefore the seat to pivot relative to the mouldings and therefore the pan 14.

In accordance with the invention the underside of approximately the rear half of the seat 10 is cut away to form a generally semi-circular cavity generally designated 38 into which a correspondingly shaped filter (see FIG. 6) can be fitted. Part of the filter is shown at 40 in FIG. 1. The thickness of the filter is commensurate with the depth of the cavity 38 so that when fitted, the underside of the filter is flush with the underside of the non-cutaway regions of the seat, such as denoted by 42 and 44.

The filter construction is shown in FIG. 3 as comprising a parallel faced core of active charcoal 46 sandwiched between two thin flat sheets of plastics material 48, 50. Along its exposed edges the charcoal is retained by wire mesh. Air can therefore only enter and leave the core via the edges, through the wire mesh 52, 53. Air inlets formed by cutaways are shown at 51, 53 and 55.

It is to be understood that the sandwiching sheets may be of any suitable material and need not necessarily be of plastics, and the wire mesh may also be replaced by a Nylon® or other plastics woven mesh or perforated sheet material which may be metal or plastics for example.

Detail of the airflow in, is seen in the cross section of FIG. 2 in which the incoming air flow is denoted by the solid black arrows 56, 58. The cavity 38 in the seat 10 is shown fully occupied by the filter 40, except in the region of the lateral cutaway 55 which allows air to enter the filter at that point, and therefore also where it abuts the cutaways 51, 53.

In order to reduce the risk of splash contaminating the filter, an inclined baffle 60 extends across the opening between the edge 55 and the inboard edge of the filter 62. The upper edge 64 of the baffle 60 is clear of the base of the cavity 38 so that air can pass around it to enter the filter. However any liquid splashed into the gap between the edge 55 and the baffle 60 will tend to be deflected out by the baffle 60, so that the filter does not become contaminated.

A similar baffle is provided at each of the other inlets 51 and 53.

The baffle and cut away region in the seat is also shown in FIG. 4, which shows how the baffle 60 also extends between opposite side walls 66, 68 of the lateral enlargement of the cavity 38. As shown the baffle 60 forms part of the plastics moulding forming the seat 10. However as explained later, it can instead be integrally formed with the underside cover sheet 50 of the filter 40.

At the rear the filter is cut away to accommodate two miniature electrically powered fans, shown in dotted outline at 70, 72 in FIG. 6. Fan 72 can be seen in the cross section of FIG. 5. Here the solid underside 50 of the filter is shown as extending at 74 to an upward lip 76 and the fan 72 closes the gap between the lip 76 and the inside of the rear wall 78 of the seat 10, so that air can only pass from the chamber 80 to the exterior of the seat via the fan 72.

The other fan 70 is similarly fitted, so that air is drawn by both fans from two rear regions of the filter. The action of the filter is to deodorise the air as it passes therethrough. The odourless air can therefore pass directly into the room containing the pan. Alternatively if desired it can be conveyed by a conduit such as a flexible hose (not shown) to an opening in a wall at the rear of the pan, to pass outside the building. However some of the advantages of incorporating a deodorising filter 40 into the air stream drawn from the pan when in use, is in that event lost. It is an advantage of the invention that there is no need for hoses or conduits between the pan/seat combination and the wall, since the air leaving the outlet at the rear of the seat should be odourless, and can be recirculated into the room.

The fans 70, 72 may be secured to the rear edge 78 of the seat so as to be separate from the filter, or may be incorporated into cavities in the filter and secured therein as shown in FIGS. 6 and 7. Here the upper cover sheet 48 of the filter is shown spaced from but extending above the fan 72 and to include a downward lip 49 to provide a second fixing point for the fan 72—the other being formed by the lip 76. The space above the fan below the upper cover sheet 48 allows air leaving the edge of the filter to pass to the top of the fans, which are operated in a direction to draw air from above them in a downward direction to exit from the underside of the fans.

FIG. 7 is a side view of a seat 10 embodying the invention fitted to a pan 14 by means of hinges such as shown in FIG. 1 and the same reference numerals have been employed in both views. A wing nut 33 is shown threaded on the stud 32 in FIG. 7. A wire 82, partly dotted as hidden detail, extends through the rear of the seat via the hinge and a passage through the stud 32. A similar wire can pass through the other hinge and stud to provide for two wires to convey current to the motors.

Additionally FIG. 7 shows by way of a partial section, the foot 84 held captive within a cavity 86 within the underside of the seat, with a compression spring 88 between the upper end of the foot 84 and the inner end of the cavity 86. As shown in FIG. 7 the seat is subjected to a downward force in the direction of arrow 90 which is sufficient to compress the spring 88 and cause the foot 84 to retract fully into the cavity 86. In this way the seat 10 can make contact with and be substantially sealed to the rim of the pan 14, (except for the cut away region 45 at the front underside of the seat 10, which allows air to enter the pan as denoted by arrows 92, 94). A switch may be arranged within one or each cavity which is normally open but which is closed as the springs are compressed and the feet 84 are forced into the cavities.

FIG. 1 shows a second foot 96 arranged symmetrically relative to 84 and housed in a similar manner to foot 84.

When no weight is carried by the seat, the springs 88 are able to extend and force the feet 84, 96 out of their cavities. This lifts the seat up clear of the rim of the pan, as shown diagrammatically in dotted outline at 98 in FIG. 7, and ensures the switch(es) if fitted remain open.

A control circuit (not shown) connected to the switch(es) is located adjacent or integral with the motors/fans to cause the or each fan to operate when a person sits on the seat and to continue to operate for a predetermined period of time such as 30 seconds, after the seat is vacated.

Although described as forming part of the seat the baffles such as 60 (see FIG. 4) may in fact be integral extensions of the lower filter cover sheet 50. By making them flexible the filter can be pushed into the cavity by pressing the baffles 60 into contact with the upper face 62 of the filter, to allow the filter to pass into the cavity. The baffles spring back to their correct position, once the filter is located within its cavity.

A DC brushless motor fan for fitting in the filter or the seat as above described may be selected from the KDE series of fans supplied by Sunon Corporation of Japan and available in Europe through Sunon SAS of France. Details of these motorised fans can be obtained from www.sunon.com or www-.sunon.fr.

In FIG. 8 et seq. the same reference numerals as have been employed in FIGS. 1 to 7 are employed to identify the same components and parts of the seat assembly.

FIG. 8 shows how two filters 100, 102, a rechargeable battery 104, a fan and motor unit 106 and a control circuit with timing mechanism 108 can be fitted into a generally C-shaped compartment 110 in the rear half of a seat 112 embodying the invention.

A charging jack socket 114 for supply with DC via a jack plug 116 from a combined transformer and AC/DC converter unit 118 for connecting into a 13 amp AC mains supply socket, for recharging the battery, is connected via cables 120 running in the compartment between the socket and the battery. The fan motor is connected to the battery 104 via the control unit 108.

A switch 122 is shown in dotted outline to the rear of one of the two feet 84, 96 (see FIG. 7 for detail) at the front end of the seat which are forced into their cavities (86 in the case of 84) when the seat is occupied. The switch 122 is normally open but is closed when the seat is occupied.

A C-shaped cover plate 124, is shown in FIG. 10. This plate is fitted over the filter units, fan, control and battery and includes tongues 126, 128 at its two ends for fitting into sockets 130, 132 respectively in the ends of the compartment 110 leaving a tortuous air path 134, visible in FIG. 9, into the filter-containing regions of the compartment.

A small button in the upper surface and the underside of each tongue 126, 128 (identified at 136, 138 and 140, 142 in FIGS. 9 to 12) serves to stand-off the tongue from the internal surfaces of each socket.

A catch clip 142 is shown at the centre of the C-shaped cover plate 124, for snap fitting to the seat 112, to secure the plate in place.

The underside 144 of the plate 124, as also the underside of the remainder of the seat, has a wipe clean surface, and is a sealing fit into the compartment except where the air inlet passages such as 134 are provided.

FIG. 9 also shows the surface 144 of the seat 112, which is of course the surface containing the feet 84, 96 and the front cutaway region 45. When the seat is lowered 144 is of course downwardly facing, and when the seat is occupied by a person the surface 144 makes sealing contact with the pan (as explained in relation to FIG. 7).

By ensuring that the thickness of the cover plate 124 is insufficient (at least in the region of the ends having the tongues 126, 128) to make contact with the pan, so an air gap will exist between the underside of the cover plate and the pan through which air from within the pan can pass via tortuous paths (134 in the case of tongue 128) to the filters 100, 102. Preferably the thickness of the C-shaped plate 124 is not uniform and an outer peripheral region of the plate is of greater thickness, so that it will make contact with and seal to the pan when the seat is lowered onto the pan and is subjected to the weight of a person seated thereon. This inhibits the entry of air below the cover plate 124 from outwith the pan.

The seat 112 as shown is somewhat different from the seat 10 of FIG. 1 in that a single outlet 146 (shown dotted) is provided through the rear edge of the seat, to allow air the exit from the fan unit 106. Although not shown in detail the fan outlet is sealingly secured to the inner compartment wall so that air from the filters can only exit via the fan unit, to outlet 146.

The invention claimed is:

1. A seat for a lavatory pan, which is adapted to be hingedly joined to the pan, the seat having a thickness, an underside, and a rear edge, and includes within its thickness a C-shaped cavity which is open to the underside of the seat, and further comprises a deodorizing filter and an electrically powered motorized fan housed in the cavity, an air inlet opening through which air can pass into the cavity, an air outlet situated in the rear edge of the seat by which odor-free air can exit after being drawn through the filter by operation of the fan, a hinge by which the seat is attachable to a rear of the pan and a flat C-shaped cover plate removably secured to the underside of the seat to cover the cavity and retain the fan and filter in place, thereby creating a filter containing region of the cavity, the cover plate being removable when it is necessary to give access to the cavity, wherein the C-shaped cavity includes two sockets, one socket being located at one end of the C-shaped cavity and the other socket being located at an opposite end of the C-shaped cavity, and the cover plate includes two tongues which in use extend into the sockets in the ends of the C-shaped cavity, each tongue defining with its socket a tortuous path for air into the filter-containing region of the cavity, and each path comprises an air inlet to the cavity.

2. A seat as set forth in claim 1 wherein the tongue and socket arrangement comprises a water trap, so that if liquid splashes onto the underside of the seat the liquid cannot penetrate to the filter.

3. A seat as set forth in claim 1, wherein the fan is incorporated between the inlet and the filter, within the filter, or between the filter and the outlet.

4. A seat as set forth in claim 1, wherein the fan is incorporated within the filter.

5. A seat as set forth in claim 1, wherein the fan is incorporated between the filter and the outlet.

6. A seat as set forth in claim 1, further comprising a battery compartment within the cavity for receiving a battery, which is to be connected to power the fan.

7. A seat as set forth in claim 1, wherein the opening is situated around an inside edge of the opening in the seat.

8. A seat as set forth in claim 1, wherein the air inlet opening is situated in a region of the underside of the seat.

9. A seat as set forth in claim 1 wherein the filter is situated in side and rear regions of the cavity, and a single fan is provided in a rear of the seat to draw air through the filter.

10. A seat as set forth in claim 1, wherein a further two cavities are provided in the underside of the seat symmetrically arranged relative to an opening in the seat and generally near an end thereof that is remote from the hinge by which it is to be joined to a pan, and two feet are provided one in each of the two cavities, a retaining device serves to hold each foot captive in its associated cavity, a spring is provided between the rear of each foot and an inner end of the cavity, the spring normally forcing the feet in a direction out of their respective cavities so as to protrude from the underside of the seat thereby in use to raise the underside of the seat away from the rim of a pan when the seat is lowered and only subject to its own weight, and wherein the springs have a spring rate which is selected so that downward force created by a weight of a person seated on the seat is sufficient to compress the springs and allow the feet to retract into their respective cavities, to allow at least a peripheral rim of the underside of the seat to make contact with the rim of the pan.

11. A seat as set forth in claim 10 further comprising a switch that is normally open, and is associated with at least one of the cavities which contain the feet, which switch will be closed when the foot is forced into its cavity.

12. A seat as set forth in claim 11 wherein the switch includes the spring, for the associated feet, which spring maintains a normally open condition of the switch.

13. A seat as set forth in claim 1 wherein the seat has a front, and a region of the underside of the seat is cut-away near the front thereof to provide a passage for inflow of air to the pan when the seat is occupied and in use and is generally sealed to the rim of the pan to prevent air from escaping from the pan between the seat and the rim of the pan.

14. A lavatory seat as set forth in claim 13 when hingedly secured to a lavatory pan which in use allows the pan to be ventilated, wherein when the seat is in its lowered position resting on the pan, air is drawn by the operation of the fan through the air inlet means to be exhausted via the outlet means in a rearwardly facing outer edge of the seat, after passing the deodorizing filter means, whereby in use substantially odor-free air is exhausted from the outlet, and fresh air is drawn into the pan through the passage provided by the cut away region in the underside of the front of the seat.

15. A lavatory seat as set forth in claim 1 when hingedly secured to a lavatory pan which in use allows the pan to be ventilated, wherein when the seat is in its lowered position resting on the pan, air is drawn by the operation of the fan through the air inlet means to be exhausted via the outlet means in a rearwardly facing outer edge of the seat, after passing through the deodorizing filter, whereby in use substantially odor-free air is exhausted from the outlet in combination with a sensor which is arranged to instigate automatic operation of the fan when the lavatory seat is in use.

16. A lavatory seat as set forth in claim 1 when hingedly secured to a lavatory pan which in use allows the pan to be ventilated, wherein when the seat is in its lowered position resting on the pan, air is drawn by the operation of the fan through the air inlet means to be exhausted via the outlet means in a rearwardly facing outer edge of the seat, after passing through the deodorizing filter, whereby in use substantially odor-free air is exhausted from the outlet in combination with a sensor which is arranged to instigate automatic operation of the fan when the lavatory is in use, which further comprises a controller including a resettable timer which in use causes the fan to operate for a predetermined period of time after the sensor has instigated operation thereof.

* * * * *